United States Patent [19]

Maddock

[11] Patent Number: 4,826,448

[45] Date of Patent: May 2, 1989

[54] ELECTRICAL CONNECTOR

[75] Inventor: William H. Maddock, Markham, Canada

[73] Assignee: Noma Inc., Scarborough, Canada

[21] Appl. No.: 27,902

[22] Filed: Mar. 19, 1987

[51] Int. Cl.[4] ..... H01R 11/20

[52] U.S. Cl. ..... 439/409; 439/414

[58] Field of Search ..... 439/389, 391, 393, 394, 439/409, 411, 412, 414, 425–428, 431

[56] References Cited

U.S. PATENT DOCUMENTS

| | | | |
|---|---|---|---|
| 791,603 | 6/1905 | Beau et al. | 439/412 |
| 2,570,751 | 10/1951 | Benander | 173/340 |
| 2,802,083 | 8/1957 | Lapeyre | 200/168 |
| 2,869,101 | 1/1959 | Benander | 339/99 |
| 3,056,943 | 10/1962 | Hull | 439/409 |
| 3,222,509 | 12/1965 | Thedford | 439/414 |

*Primary Examiner*—Gil Weidenfeld
*Assistant Examiner*—Paula A. Austin
*Attorney, Agent, or Firm*—Kenneth M. Garrett

[57] ABSTRACT

An electrical connector includes stab portions and a cam for urging a wire cord into contact therewith. The cam mounts in a tubular housing which is telescopically receivable in a sleeve. The cam and housing coact such that the cam head tends to move outwardly from the housing when the cam is moved to a position to release the wire cord, and this is prevented by the sleeve. As a corollary, if the cam is turned away from its wire locking position, the housing cannot be engaged with the sleeve. The sleeve acts as a conduit for the wire cord, whereby the cord tends to anchor the housing in telescoped position in the sleeve, to prevent unauthorized tampering with the connector.

16 Claims, 5 Drawing Sheets

L
82
64
60
38
40
40
62
56
30
28
36
34
96
92
98
102
46
94
100
26
24
22

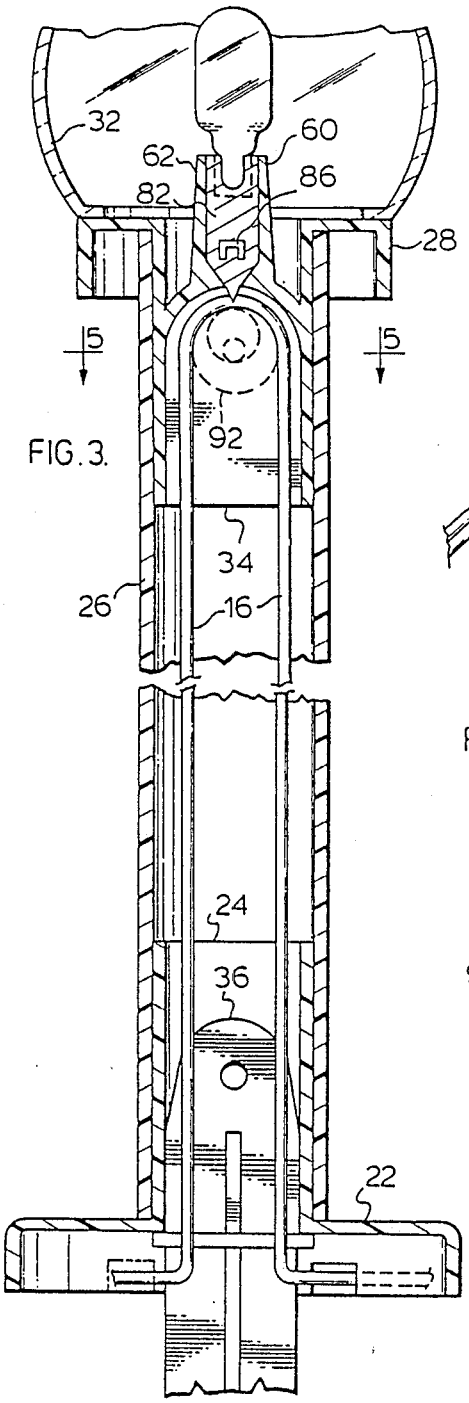
FIG. 3.
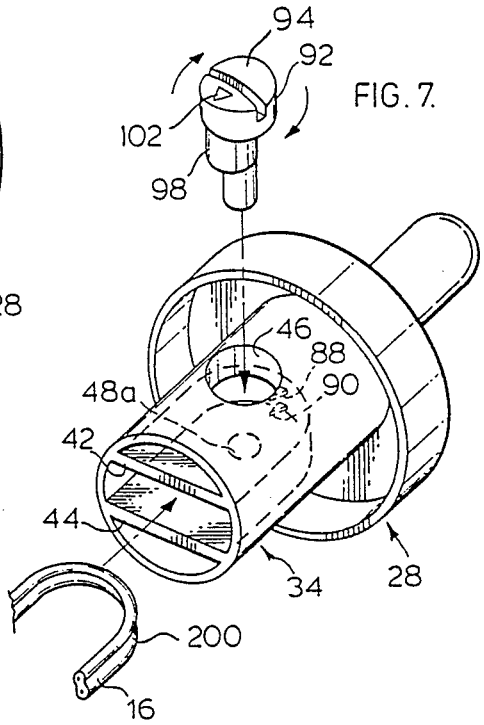
FIG. 7.
FIG. 5.
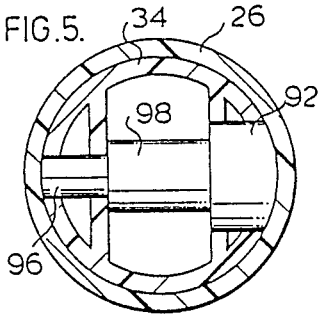
FIG. 6.
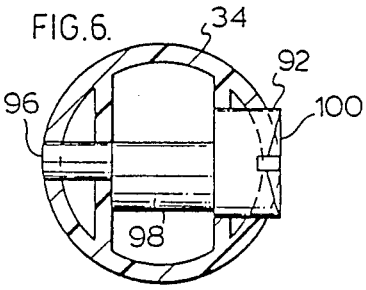

ELECTRICAL CONNECTOR

FIELD OF INVENTION

This invention relates to electrical connectors. It particularly relates to connectors such as may be used with decorative light strings, although it is not necessarily restricted thereto.

BACKGROUND OF INVENTION

In decorative light strings such as are festooned on Christmas trees, the light strings are normally produced in a factory operation in which the light sockets are molded onto a wire cord. Such decorative lights are sufficiently small that the strings can be easily packaged and handled, and the fixed spacing between the socket is not generally seen as being disadvantageous.

By contrast, patio lighting sets are considerably more bulky due to the general use of lens assemblies or diffusers, and due also to the appreciably greater distance normally provided for between adjacent lights, thereby creating difficulty in packaging, setting up and taking down and storing of the patio lights. The fixed spacing between adjacent light units is often seen as a disadvantage, as it may not permit the lights to be positioned to their best advantage.

The wiring of electrical sockets using screw connectors is beyond the capability of many persons, and the risk of creating a hazardous situation increases with the number of connections being made, even though the person be of moderate competence.

While it is known to provide connectors for electrical cords which do not necessitate the cord being cut and the ends being prepared, such connectors are not generally suitable for use in outdoor lighting as they are more or less susceptible to their being electrically disconnected, either by accident or by their being tampered with.

It is then a prime object of this invention to provide a simple connector for electrical use.

It is another object of the invention to provide a connector of the foregoing type which may be used to interconnect a plurality of electrical sockets or the like to a continuous wire conductor at any position therealong, without necessitating the cutting of the wire conductor.

It is yet another object of the invention to provide a connector which locks into position on a wire conductor, whereby it may not be accidentally removed therefrom, and whereby the electrical connection thereto may not be accidentally weakened.

It is a further object of the invention to provide a connector of the foregoing type wherein the final assembly of the parts thereof is restricted until such time as the wire conductor is locked into position in the connector.

It is still a further object of the invention to provide a connector in which the wire locking mechanism is enclosed, following assembly, whereby it is less readily tampered with and whereby it is not susceptible to being accidentally opened.

SUMMARY OF THE INVENTION

In accordance with a broad aspect of the invention, a connector comprises wall means extending in a first axial direction, which wall means includes portions extending in diametric opposition. At least one of the wall portions has an opening therethrough intermediate the axial ends thereof. A bridging wall is provided adjacent one axial end of the wall means; the bridging wall supports an electrode which includes a stab portion projecting between the wall portions. The connector further includes a cam means, and bearing means mounting the cam means for rotation about an axis transverse to the first axial direction. The cam means includes an end portion projecting through the opening in the wall portion, and a cam surface underlying the stab connector to permit the free passage of a wire conductor between the cam surface and the stab connector when the cam means locates in a first rotational position, and which urges the wire conductor into conducting relationship with the stab connector when in a second rotational position. The end portion of the cam means and the wall portions together present a first cross sectional aspect when the cam means is in the second rotational position, and a second, enlarged cross sectional aspect when the cam means is rotated from the second position towards the first position. A sleeve means is provided which is configured to permit the engagement of the wall means therewith when the first cross sectional aspect is presented, and to restrict the engagement of these parts when the second, enlarged cross sectional aspect is presented. Additionally, the sleeve means serves to interfere with the cam means when the wall means is engaged therewith, so as to prevent the rotation of the cam means from its second position to its first position.

In accordance with a preferred embodiment, the wall means is formed by a circular cylinder, the opposed wall portions forming portions of the cylinder wall. The end of the cam means forms a cylindrical segment, when considered in elevation, and when the cam means is in the second position, the end generally forms a continuum with the surrounding wall portions of the cylinder defining the opening. As the cam means is rotated from this second position, so the end projects beyond the cylinder wall to increase the cross-sectional aspect of the arrangement. When the cam means is in the second position, the cylinder enters snugly within the sleeve, and the cam means is prevented from turning, thereby retaining a wire conductor securely in electrically conducting relationship with the stab connector. However, when the cam means is in the second position, the wall means is denied entry to the sleeve, hence the portions cannot be assembled with the conductor only partly locked onto the stab connectors.

Generally speaking it will be preferred that the connector will include a pair of transversely spaced apart electrodes, each having a stab portion to provide an interconnection with the dual wires of a molded electric cord.

The invention will be further described in relation to a preferred embodiment thereof, taken in conjunction with the accompanying drawings, wherein FIG. 3 is located on the fourth sheet of drawings, immediately following FIG. 4.

BRIEF DESCRIPTION OF THE DRAWINGS

FIG. 3 is an axial cross section of the luminaire;

FIG. 5 is a cross section taken on 5—5 of FIG. 3 in the direction of the arrows;

FIG. 6 is similar to FIG. 5, but shows the cam rotated through 90° about its axis;

FIG. 7 is a perspective view from below of the portion of the luminaire seen in FIG. 4, suggesting the manner of operation thereof;

DESCRIPTION OF THE PREFERRED EMBODIMENT

Figure 1:
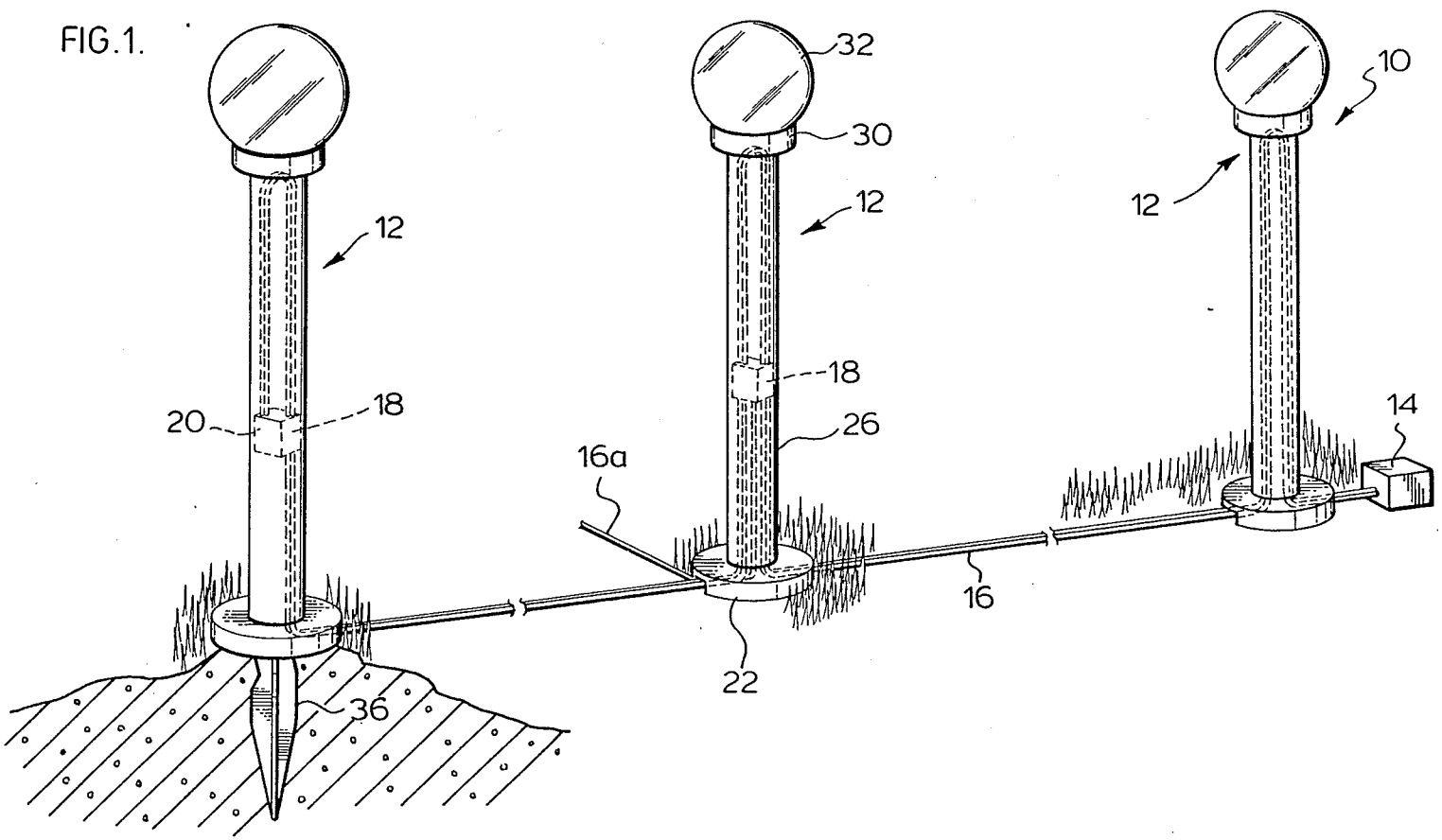
FIG. 1 is a perspective view of a plurality of luminaires interconnected in a string to form a patio lighting set.
Figure 2:
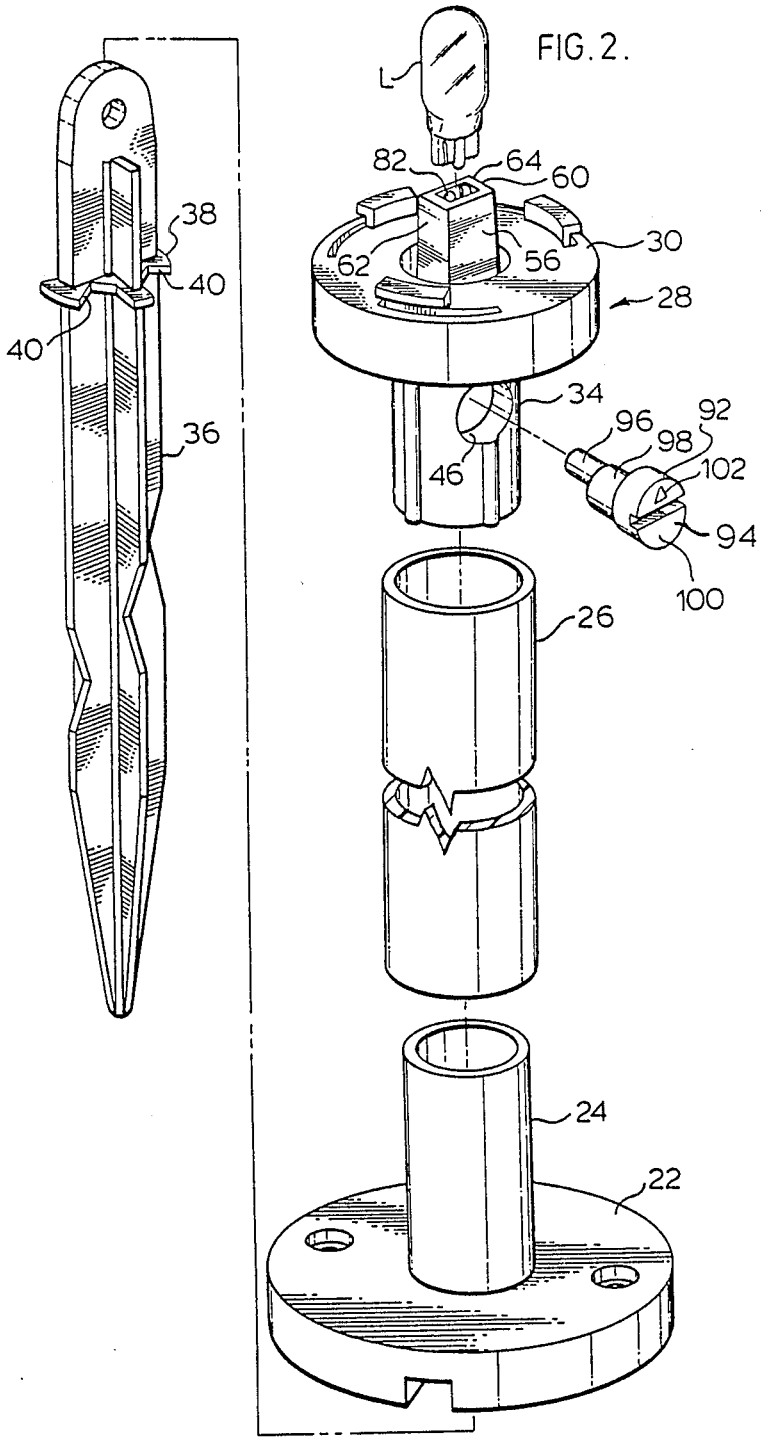
FIG. 2 is an exploded perspective view of one of the luminaires.
Figure 4:
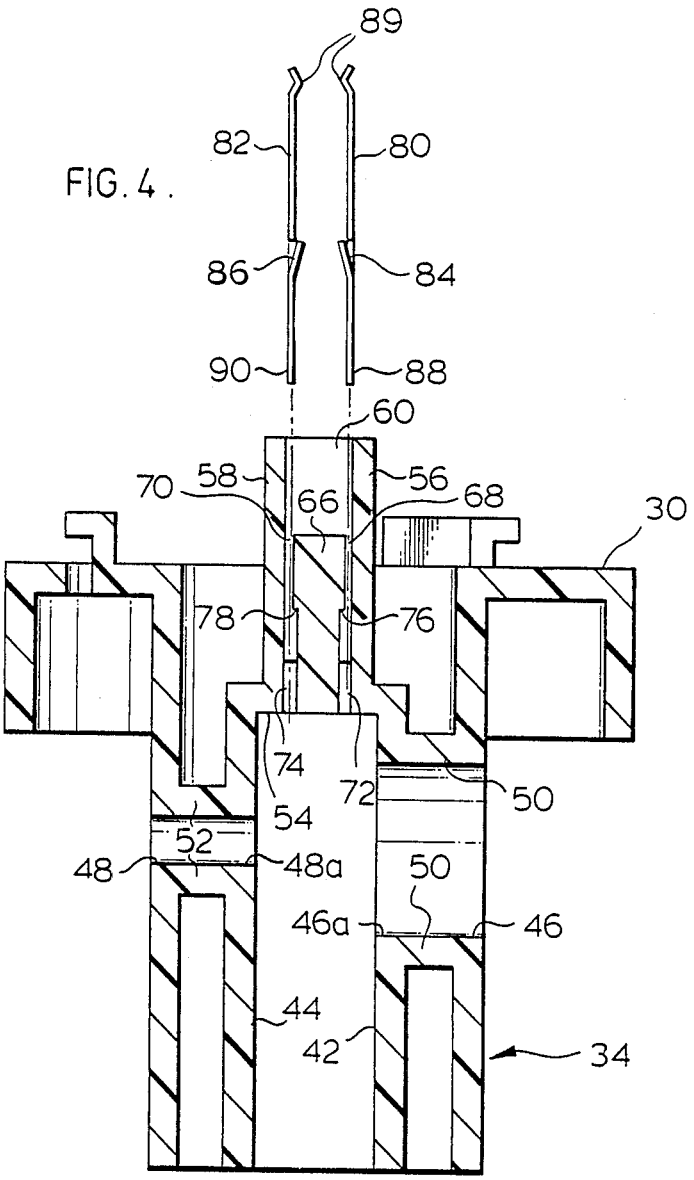
FIG. 4 is an exploded axial cross section of the upper portion of the luminaire, transverse to the cross section of FIG. 3.
Figure 8:
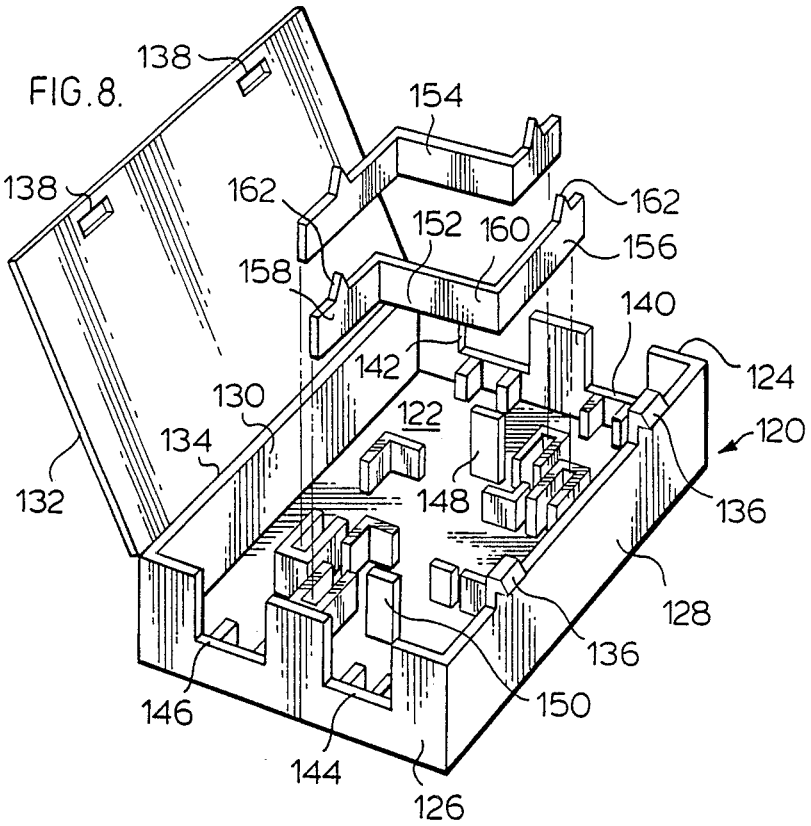
FIG. 8 is an exploded perspective view from above of a splice connector that finds use with the patio lighting set.
Figure 9:
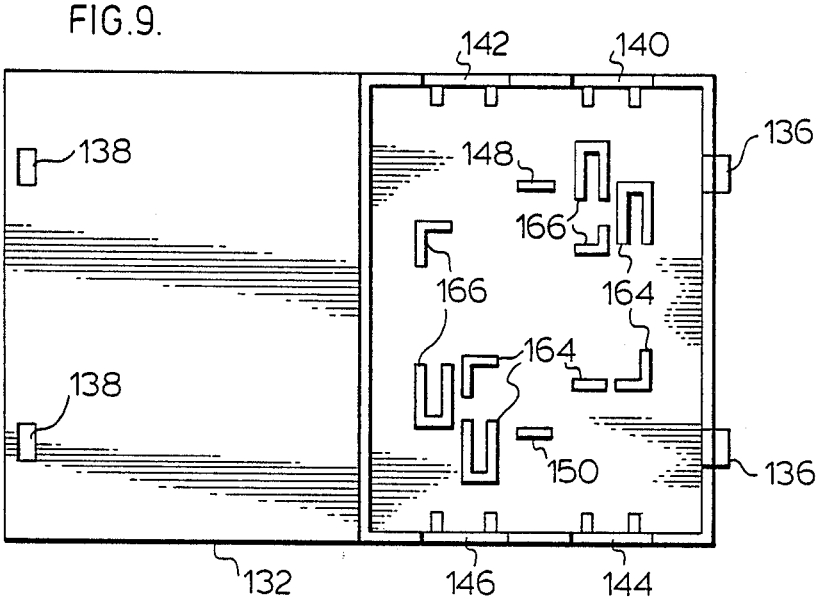
FIG. 9 is a plan view of the splice connector, with the electrodes removed for clarity.

Referring to the Figures in detail, a patio lighting set is identified generally therein by the numeral 10. The patio lighting set comprises a plurality of luminaires 12 connected to a power source illustrated schematically and identified by the numeral 14. Luminaires 12 are connected in parallel electrical relationship by a twin conductor electrical cord 16, which may suitably be a single length, to form a string of lamps. Provision is made to branch the string, as along path 16a preferably using a splice connector 18 which does not necessitate the cutting of cord 16. Connector 18 will subsequently be described in greater detail, but other forms of connection as are presently known may also be employed. Connector 18 also has a utility in insulating the free end 20 of cord 16.

Luminaire 12 comprises a base 22, having an upstanding collar 24 thereon; a standard 26 is telescopically receivable on the collar 24. At the upper end of standard 26 is a lamp assembly 28 comprising a platform 30 from which is detachably mounted a decorative light diffuser 32 and a downwardly depending collar 34 which is telescopically receivable in the upper end of standard 26.

Where luminaires 12 of the patio lighting set 10 are to be mounted from the ground, a stake 36 is provided. Stake 36 is telescopically receivable in collar 24 of base 22, being insertable therein from the underside of the base. A flange 38 limits the penetration of stake 36 within collar 24. A plurality of cut outs 40 are provided in flange 38 to provide a restricted wire entry passage to standard 26 for cord 16.

Collar 34 is generally circular in cross section. A pair of axially aligned walls 42,44 are provided within collar 34 equispaced on opposed sides of the diametric plane of the collar. Collar 34 has a relatively large circular opening 46 in the exterior wall thereof, which opening extends to the interior of the collar; an identical opening **46*a* is formed in the axial wall 42 adjacent opening 46. Coaxial with opening 46 and on a diameter transverse to the axial plane a smaller circular opening 48 is formed in collar 34, with a similar opening 48*a* is adjacent axial wall 44. Openings 46,46*a* are bridged therearound as are openings 48,48*a* by cylindrical walls 50,52** respectively.

The upper end of collar 34 is bridged by a wall 54 extending between axial walls 42,44. There extends upwardly from wall 54 a second pair of axial walls 56,58, the spacing therebetween being somewhat less than that between walls 42,44 with which they are parallel. Walls 56,58 are interconnected at each lateral side along their length by walls 60,62, thereby forming an axially extending rectangular tube 64. Intermediate axial walls 56,58 there locates a spacer wall 66 which extends upwardly from bridging wall 54 to about one half of the length of rectangular tube 64, thereby defining a pair of narrow passageways 68,70. Passageways 68,70 extend through bridging wall 54, at 72,74, the lateral dimension of the passageways being reduced in this portion. By contrast, the width of the passageways is somewhat increased in this portion and thereabove, so as to provide undercuts 76,78 in spacer wall 66 in medial portions thereof intermediate the ends of passageways 68,70.

A pair of strip electrodes 80,82 locate in rectangular tube 64, the lower ends of the electrodes being securely constrained and positioned respectively in passageways 68,70. Each electrode has an inwardly deformed tang, 84,86 which tangs respectively engage undercuts 76,78. Each electrode 80,82 adjacent its lower end has its minor edges which are broadly downwardly convergent, so as to seat in convergent openings 72,74 when tangs 84,86 are locked behind undercuts 76,78. Beneath the broadly convergent edges of electrodes 80,82, the ends of the electrodes are sharply convergent at 88,90 respectively, which portions extend below the lower surface of bridging wall 54 into the space between axial walls 42,44. The upper ends of electrodes 80,82 are inwardly deformed at 89 so as to grip the lamp base and provide an electrical connection therewith. The internal lateral dimension of tube 64, will be selected so as to provide a positive positioning of the base of lamp L when inserted into the tube. Lamp assembly 28 further includes a cam 92 having a head 94 and a tail 96 coaxial therewith, and a cam lobe 98 therebetween. Head 94 and tail 96 are circular in cross section, and are proportioned such that cylindrical walls 50, 54 form bearing surfaces therefor. Cam 92 is insertable into position in collar 34 through opening 46. The outwardly facing surface 100 of the cam head 94 is saddle shaped and radiused on the axis of collar 34 such that when in axial alignment with the axis of collar 34, the surface generally forms a continuum with the outwardly facing surface of the collar. When in this aligned position, lobe 98 approaches most closely to ends 88,90 of electrodes 80,82, or, when the cam 92 is rotated about its axis through 180°, lobe 98 will be most distant from electrode ends 88,90. Head surface 100 is provided with an indicator in the form of an arrow head 102 which serves to indicate the position of lobe 98. When cam 92 is in its axially aligned position, collar 34 is insertable into the upper end of standard 26; however, when the cam is rotated from its axially aligned position, the head surface 100 of the cam will project radially beyond the outer surface of collar 34, as seen in FIG. 6, and will interfere with the wall of standard 26 to prevent the entry of the collar therein. As a corollary, when the collar 34 is telescopically received in standard 26, as seen in FIG. 5, cam 92 will be locked into its axially aligned position.

Splice connector 18 comprises a small insulated housing 120 formed by an axially elongated base wall 122, end walls 124,126 and side walls 128,130. A lid 132 connects to side wall 130 by a live hinge 134. Snap catches 136 are provided on side wall 128 to cooperate with openings 138 formed in lid 132 to retain the lid in a closed position.

Side wall 128 has a pair of openings 140,142 therethrough; a similar pair of openings 144,146 are formed in end wall 126, the pairs of openings being in axial alignment to define first and second wire paths through housing 120. These wire paths are also defined in part by a pair of axially spaced apart walls 148,150 located between the wire paths.

Splice connector 18 further comprises a pair of identical electrodes 152,154. The characteristics of only one of the electrodes will be specifically enumerated so as to avoid duplication. Electrode 152 comprises parallel end portions 156,158 interconnected by an off setting portion 160 in a generally Z shaped formation. End portions 156,158 are each furnished with a barb 162 upstanding from the minor edge thereof.

Electrodes 152,154 are retained within housing 120 in spaced apart nested relationship, with the end portions 156 of each electrode in axial alignment along the first wire path, and the end portion 158 of each electrode in axial alignment along the second wire path. Electrodes 152,154 are retained in their spaced apart relationship respectively by a first and second plurality of walls 164,166 upstanding from base wall 122. Walls 164,166 surround the end portions 156,158 of electrodes 152,154 on three sides thereof, so as to preclude the lateral and axial movement of the electrodes.

Having described the preferred embodiment of the invention, its manner of operation will now be discussed. Patio lighting set 10 will normally be distributed in an unwired condition, whereby the user may determine the preferred spacing between the luminaires 12 to form a string, and create branch paths **16*a* from the string to suit individual circumstances. In wiring a luminaire 12, standard 26 will be engaged with the collar 24 of base 22 to form a first subunit, and a loop 200 of cord 16 will be pushed through the standard from beneath the base, to exit the open, upper end of the standard. Loop 200 will be pushed between axial walls 42,44, which are spaced apart so as to constrain lateral movement of the cord, to abut the loop with the sharp ends 88,90 of electrodes 80,82. Cam 92 will then be introduced into its bearings, with lobe 98 directed away from electrode ends 88,90, thereby permitting cord 16 to pass freely between the cam surface and the electrode ends, so as to allow for any desired adjustment of the position of luminaire 12 along cord 16. Following this adjustment, cam 92 is rotated about its axis through 180°, thereby biasing cord 16 into contact with electrode ends, 88,90** so as to stab through the insulation of the cord and create an electrical contact with the wire conductors.

Lamp assembly 28 is then engaged with standard 26 by telescoping collar 34 into the upper, open end of standard 26 until the underside of platform 30 abuts the standard, thereby securing cam 92 in its locked position. Cord 16 may then be pulled downwardly through the base 22 of luminaire 12 and the base secured in position on any surface, for example a ground surface using stake 36. When luminaire 12 is so secured, it will be very difficult to disengage lamp assembly 28 from standard 26 to gain access to cam 92, as cord 16 acts to restrain upward movement of the lamp assembly. Although in the illustrative embodiment light diffuser 32 is shown as being omnidirectional, other light diffusers or refractors may be employed having directional characteristics. In that instance it will be appreciated that while the mechanical arrangement constrains the upward movement of lamp assembly 28 on standard 26, rotational movement of the lamp assembly about its axis is essentially unhindered.

When it is desired to create a branch path 16a using splice connector 18, cord 16 is layed along one wire path through housing 120 for example through end wall openings 146,150, and the end of a separate length of cord is introduced to the housing along the other wire path. The closure of lid 132 then biases the cords downwardly whereby barbs 162 pierce the cord insulation to create an electrical contact, so interconnecting the two ends.

While electrodes 152,154 of splice connector 18 are identical, it will be appreciated that other arrangements could equally be employed. It will also be apparent that many departures from the other aspects of the specifically described preferred embodiment of the invention could equally be made, and it is intended that these be convered by the claims appended hereto.

I claim:

1. An electrical connector comprising:

a tubular member open at one axial end thereof and having an opening in the cylinder wall intermediate the ends thereof;

a radial wall located adjacent the other end of said tubular member;

an electrode mounted from said radial wall, said electrode including a stab connector portion projecting within said tubular member;

a cam;

means mounting said cam for rotation within said tubular member, about an axis transverse to the axis thereof;

said cam including a cam surface locating beneath said stab connector portion, and a head surface projecting through said opening in said cylinder wall, said head surface generally forming a continuity with the outer surface of said cylinder wall when said cam surface is closest to said stab connector portion, and a discontinuity with said cylinder wall which tends to enlarge the cross section area thereof in at least one transverse section when said cam is rotated to move said cam surface away from said stab connector portion and a standard having a hollow upper end adapted to receive and support said tubular member therein in surrounding relationship with the head surface of said cam.

2. An electrical connector as defined in claim 1, wherein said cam is insertable into said tubular member through said cylinder wall opening.

3. An electrical connector as defined in claim 1, wherein said tubular member has a generally circular cross section.

4. An electrical connector as defined in claim 3, wherein said tubular member includes an opposed pair of parallel walls extending axially therein and wherein said stab connector portion locates between said parallel walls.

5. An electrical connector as defined in claim 4, including a second electrode mounted from said radial wall, said second electrode including a stab connector portion projecting within said tubular member between said parallel walls.

6. An electrical connector as defined in claim 5, wherein said parallel walls are each provided with an opening therethrough coaxial with said radial wall opening, thereby forming journal bearings for said cam to provide said cam mounting means.

7. An electrical connector as defined in claim 5, wherein said head surface includes indicia thereon for indicating the position of said cam surface relative to said stab connector.

8. An electrical connector as defined in claim 5, wherein said standard forms a conduit for an electric cord to be connected to by said electrical connector.

9. An electrical connector as defined in claim 5, wherein said first and second electrodes are adapted to grip the base of a lamp therebetween.

10. An electrical connector comprising:

insulating support structure defining a pair of parallel, axially extending passageways open at the upper end thereof;

wall means located to generally restrict the lateral dimension of said passageways adjacent the lower end thereof; said passageways having an increased width in medial portions thereof adjacent said lower end to provide an undercut therealong;

an axially extending electrode positioned in each passageway;

each said electrode including a tang extending outwardly and upwardly therefrom located to engage one said undercut to lock said electrode in said passageway;

a tubular wall defining a cord passage downwardly depending from said wall means;

each said electrode terminating at its lower end is a stab connector locating within said cord passage, and cam means and means mounting said cam means for rotation within said cord passage about an axis transverse to said passageway;

said cam means having a cam surface positioned to urge a wire conductor against said stab connectors as said cam means is rotated, wherein said cam means comprises a plug having an outwardly facing head surface profiled such that when said plug is rotated to a position wherein said cam surface is in closest proximity to said stab connectors, said head surface locates within the exterior boundary of said tubular wall, and when said cam means is rotated about its axis to move said cam surface away from said stab connectors, said head surface projects beyond said exterior boundary.

11. An electrical connector as defined in claim 10, wherein each said electrode is downwardly convergent in a portion thereof intermediate said stab connector and said tang, and wherein said wall means restricting said passage is correspondingly downwardly convergently formed so as to provide a seat for said electrodes.

12. An electrical connector as defined in claim 10, wherein said tubular wall has a generally circular exterior boundary.

13. An electrical connector as defined in claim 12, wherein said cord passage is restricted by a pair of axially extending spaced apart walls connected to said tubular wall on the interior thereof.

14. An electrical connector as defined in claim 10, wherein said tubular wall has a relatively large opening therein forming in part said means for mounting said cam means.

15. An electrical connector as defined in claim 14, wherein said cam means is insertable into said wire passage through said opening in said tubular wall.

16. An electrical connector comprising:

wall means extending in a fist axial direction, said wall means including wall portions in diametric opposition;

at least one of said wall portions being provided with an opening therethrough intermediate the ends thereof;

a bridging wall adjacent one axial end of said wall means to interconnect said opposed wall portions;

an electrode mounted from and extending above said bridging wall, said electrode including a stab connector portion projecting between said opposed wall portions;

a cam means;

bearing means mounting said cam means for rotation about an axis transverse to said first axial direction;

said cam means including an end portion projecting through said opening in said wall portion;

said cam means further including a cam surface underlying said stab connector and permitting the free passage of a wire conductor between said cam surface and said stab connector portion when said cam means locates in a first rotational position and to urge the wire conductor into conducting relationship with said stab connector portion when said cam means locates in a second rotational position, said end portion and said wall means together presenting a first cross sectional aspect when said cam means locates in said second rotational position and an enlarged cross sectional aspect when said cam means is rotated from said second rotational position towards said first rotational position;

sleeve means configured to permit the engagement therewith of said wall means when said first cross sectional aspect is presented, and to restrict the engagement therewith of said wall means when said second cross sectional aspect is presented, said sleeve means further serving to interfere with said cam means to prevent the rotation thereof when said wall means is engaged with said sleeve means.

* * * * *